US005568123A

United States Patent [19]

Derheim

[11] Patent Number: 5,568,123

[45] Date of Patent: Oct. 22, 1996

[54] CHILD PROTECTIVE CABINET ALARM

[76] Inventor: Charles F. Derheim, 34811 18th Ave. S.W., Federal Way, Wash. 98023

[21] Appl. No.: 490,817

[22] Filed: Jun. 15, 1995

[51] Int. Cl.[6] ..... G08B 13/08

[52] U.S. Cl. ..... 340/545; 200/61.62; 200/61.93; 340/546; 340/570

[58] Field of Search ..... 340/546, 545, 340/570; 200/61.62, 61.93

[56] References Cited

U.S. PATENT DOCUMENTS

| | | | |
|---|---|---|---|
| 1,099,777 | 6/1914 | Sundel | 340/546 |
| 1,562,574 | 11/1925 | Maud | 340/546 |
| 2,259,696 | 10/1941 | Hulst | 340/546 |
| 3,932,856 | 1/1976 | Tremont | 340/546 |
| 4,052,718 | 10/1977 | Tucci et al. | 340/545 |
| 4,194,193 | 3/1980 | McDonough | 200/61.93 |
| 4,264,899 | 4/1981 | Menzies et al. | 340/546 |
| 4,438,428 | 3/1984 | Ober et al. | 340/521 |
| 4,688,023 | 8/1987 | McGill et al. | 340/545 |
| 4,808,974 | 2/1989 | Cantley | 340/546 |
| 4,977,392 | 12/1990 | Loda | 200/61.93 |

*Primary Examiner*—Glen Swann
*Attorney, Agent, or Firm*—Joan H. Pauly

[57] ABSTRACT

A device is mounted inside the interior space defined by a cabinet to alert a supervising adult that a child has opened the cabinet door. The device is mounted so that an outer face of its housing is directed outwardly adjacent to the opening closed by the door. A perpendicular mounting end is attached to an inner sidewall surface of the cabinet. An activator switch has a lever or button biased to project outwardly from the outer face of the housing. The closing of the cabinet door moves the projecting lever into a depressed position. When the cabinet door is opened, movement of the lever into a projecting position activates an audible alarm. In alternate embodiments, one or more of the components of the device may be provided in a separate housing part mounted outside the cabinet.

5 Claims, 2 Drawing Sheets

CHILD PROTECTIVE CABINET ALARM

TECHNICAL FIELD

This invention relates to devices for signaling that a closure for an opening in a structure has been moved out of its closed position and, more particularly, to such a device having a housing mountable in the interior space of a structure so that an outer face of the housing confronts the opening and an activator switch with a projecting portion within the periphery of the face is depressed by the closure when the closure is moved inwardly into its closed position.

BACKGROUND INFORMATION

There are a number of situations in which it is desirable to have a method of detecting movement of a closure for an opening in a structure out of its closed position. Such situations involve various types of structures. One example is an occupied dwelling, such as a room in a hotel or a home with opening doors and windows. In this example, an alarm device can serve to alert occupants of the unauthorized entry of an intruder through a door or window.

Another example is a storage area, such as a cabinet or drawer, where articles that may be dangerous to children are kept in a home or other facility where children are present. In this type of situation, it is desirable to prevent access by children to the storage area or, failing prevention of access, to immediately alert an adult that a child has gained access. The alerting of an adult can avert tragedy when a storage area is not locked or, as sometimes happens, an allegedly childproof lock is opened by a child.

Although the basic goal of signaling that undesired access to a structure has been gained is the same in both of the two types of situations described above, the two situations present different sets of problems. In the case of unauthorized access by an intruder into an occupied structure, the alarm device is most commonly associated with an inwardly opening closure, such as a door. In addition, the person to be alerted is inside the structure. In the case of storage areas the closure is normally opened outwardly, and the person to be alerted is outside the structure. Since the person is outside the structure, the alarm cannot be set from inside the structure.

The patent literature includes a number of examples of portable burglar alarms for use especially by travelers staying in hotel rooms. The patents include U.S. Pat. Nos. 1,099,777, granted Jun. 9, 1914, to S. Sundel; No. 1,562,574, granted Nov. 24, 1925, to G. J. Maud; No. 2,259,696, granted Oct. 21, 1941, to C. P. Hulst; No. 3,932,856, granted Jan. 13, 1976, to Leo J. Tremont; No. 4,264,899, granted Apr. 28, 1981, to John I. Menzies et al.; No. 4,438,428, granted Mar. 20, 1984, to John W. Ober et al.; and No. 4,808,974, granted Feb. 28, 1989, to Richard E. Cantley. Each of the alarms disclosed in these patents is designed to be set by the room occupant from inside the room and to be used with an inwardly opening door. The device disclosed by Tremont may also be used with an outwardly opening door. The Sundel device is attached to the door and is operated by a chain which engages a lever. The Maud, Hulst, Tremont, and Menzies et al. devices are placed on the floor by the door and are operated by movement of the door causing movement of all or part of the device. The Tremont device may also be operated by a string or by a gravity operated lever when the device is used with an outwardly opening door. Each of the Ober et al. and Cantley devices is mounted on the door and has a lever that projects upwardly from the device and is biased to pivot into a position in which it projects rearwardly from the device. The device is hooked onto the top of the door with the lever positioned against the door frame to stop rotation of the lever.

SUMMARY OF THE INVENTION

The subject of the invention is a warning device for use with an outwardly opening closure for an opening in a structure defining an interior space accessible through the opening. The closure has a closed position in which it closes the opening and is movable outwardly away from the interior space and the opening from the closed position to an open position to provide access to the interior space. The device signals that the closure has been moved out of its closed position toward its open position.

According to an aspect of the invention, the device comprises a housing having an outer face and a mounting end substantially perpendicular to the face. The mounting end is attachable to the structure to position the device inside the interior space with the face directed outwardly adjacent to the opening. The face is bounded by a periphery and has an aperture extending therethrough within the periphery. An audible alarm is carried by the housing. An activator switch is mounted in the housing and has a projecting portion biased into a projecting position in which it projects outwardly through the aperture. The projecting portion is movable out of its projecting position toward the face and into a depressed position. The projecting portion is and remains within the periphery of the face when it is in either of its projecting and depressed positions and as it moves between its projecting and depressed positions. The activator switch normally is operatively connected to the alarm so that the alarm is activated when the projecting portion is in its projecting position and is deactivated when the projecting portion is in its depressed position. A disable switch is mounted on the housing in a position accessible for manual operation. The disable switch is manually movable into a position in which it prevents activation of the alarm by movement of the projecting portion of the activator switch into its projecting position. The projection portion is configured to be contacted and moved into its depressed position by the closure when the mounting end of the housing is attached to the structure, the housing face is directed outwardly adjacent to the opening, and the closure is moved into its closed position.

The device may be attached to the structure in various ways. One preferred way of mounting the device is by using a fastener comprising a strip of material with opposite faces. Each of the faces has a layer of pressure sensitive adhesive thereon. One of the faces is secured to the mounting end by the adhesive.

The housing of the device may be provided in the form of a one-piece housing or may include a plurality of separate parts. In a first preferred embodiment of the invention, the housing is a one-piece housing, and the disable switch is mounted spaced from the mounting end of the housing on a surface of the housing substantially perpendicular to the face. In another preferred embodiment, the housing includes first and second parts. The first part includes the mounting end and the face and has the activator switch mounted therein. The second part is separate from the first part to permit it to be positioned, in use, outside the interior space of the structure. One or more of the components may be carried by the second part. For example, the disable switch may have portions carried by each of the two parts. A manual operator and a transmitting portion may be carried by the second part, with a receiving portion being carried by the first part. Another possible arrangement is one in which both the disable switch and the alarm are carried by the second part.

The device of the invention has a combination of features that make it easy to use and give it a high degree of versatility and reliability while maintaining simplicity of structure and cost effectiveness. The one-piece housing or housing part that is mounted within the interior space of the structure may be mounted on the interior surface of a top wall, bottom wall, or sidewall of the structure defining the interior space or on a lip surrounding the opening. The positioning of the activator switch so that its projecting portion projects outwardly through an aperture in the face makes the device easily positionable so that the closure will contact the activator switch when it is moved into its closed position. This enables the activator switch to be set even though there is no access for setting the switch from within the space. In addition, the confining of the projecting portion so that it is always within the periphery of the housing face from which it projects keeps the projecting portion out of the way of an adult accessing the interior space and helps prevent damage to the switch by accidental striking of the switch when an adult is gaining access or placing articles in or taking articles out of the interior space.

These and other advantages and features will become apparent from the detailed description of the best modes for carrying out the invention that follows.

BRIEF DESCRIPTION OF THE DRAWINGS

In the drawings, like element designations refer to like parts throughout, and.

BEST MODES FOR CARRYING OUT THE INVENTION

Figure 1:
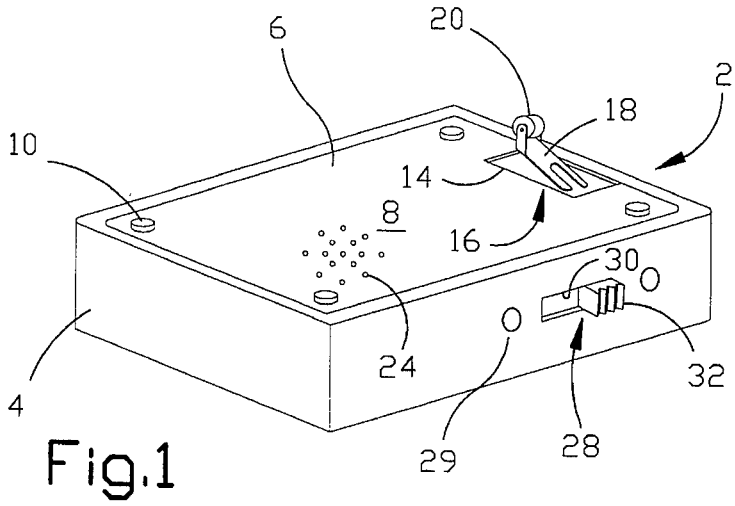
FIG. 1 is a pictorial view of a preferred embodiment of the invention.
Figure 2:
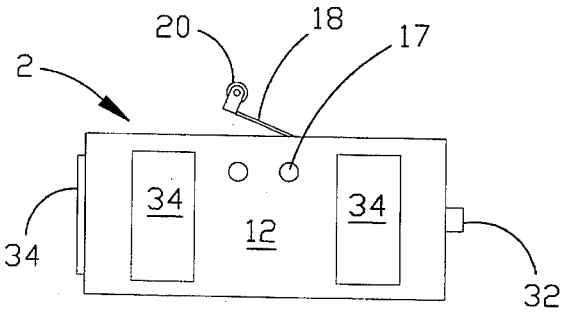
FIG. 2 is a top plan view of the device shown in FIG. 1.
Figure 3:
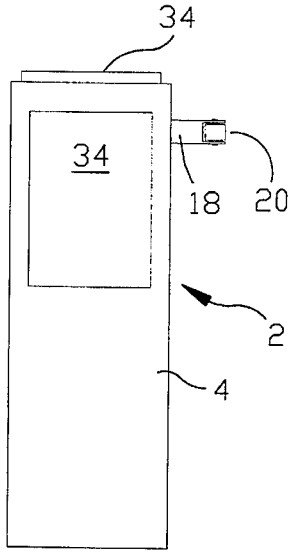
FIG. 3 is a side elevational view of the device shown in FIG. 1, showing the side opposite the side from which the disable switch operating member extends.
Figure 4:
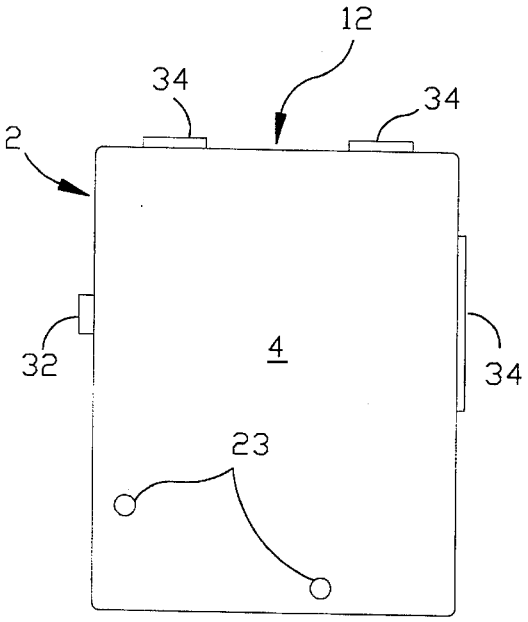
FIG. 4 is a rear elevational view of the device shown in FIGS. 1–3.
Figure 5:
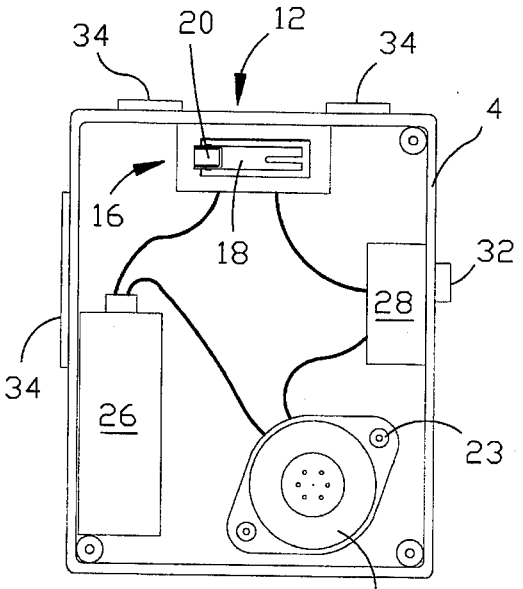
FIG. 5 is a front elevational view of the device shown in FIGS. 1–4 with the cover plate removed.
Figure 6:
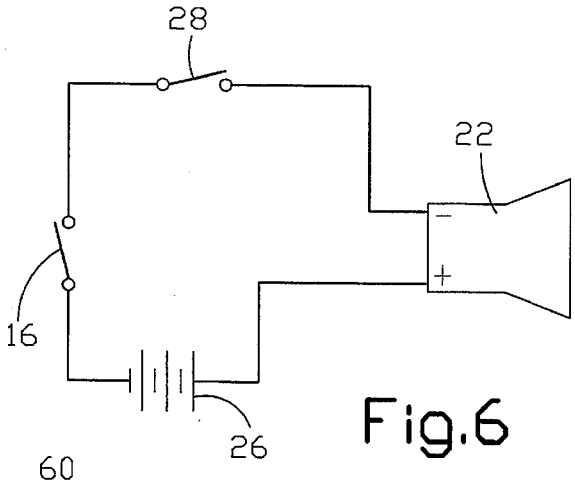
FIG. 6 is a circuit diagram for the device shown in FIGS. 1–5.
Figure 8:
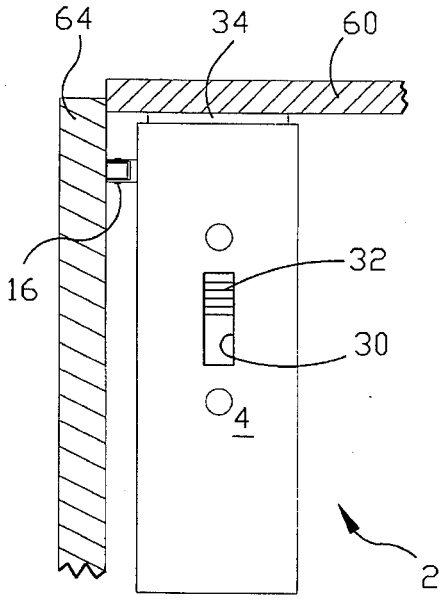
FIG. 8 is a fragmentary sectional view showing the device mounted as in FIG. 7 but with the cabinet door closed.
Figure 7:
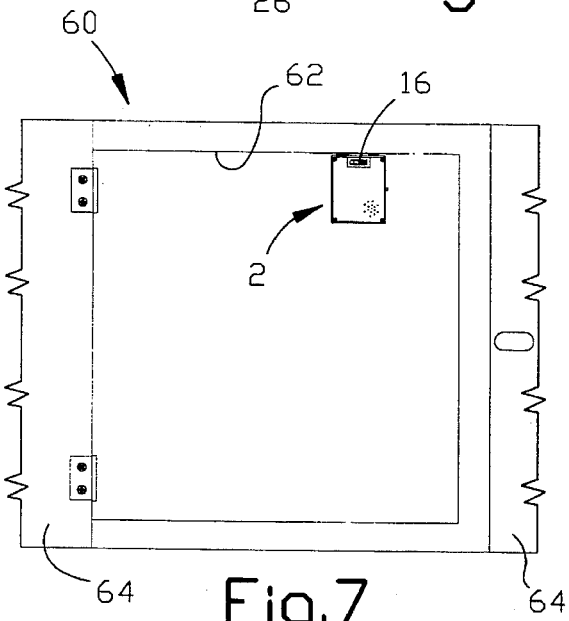
FIG. 7 is a front elevational view of the device shown in FIGS. 1–6 mounted in a cabinet, with the cabinet door open.

The drawings show devices that are constructed according to the invention and that constitute the best modes for carrying out the invention currently known to the applicant. In FIGS. 7 and 8, an embodiment of the device 2 is shown mounted in a cabinet 60 of a common construction. It is anticipated that the primary use of the invention will be in cabinets of the type shown in FIGS. 7 and 8 and similar cabinets. However, it is intended to be understood that the device may also be used to advantage in connection with other types of cabinets and other types of structures enclosing storage areas. For example, in some circumstances, the device of the invention could be used in conjunction with a drawer.

Referring to FIGS. 1–8, the first preferred embodiment of the device 2 has a one-part housing 4, 6. The housing 4, 6 includes a five-sided body 4 and a cover plate 6 that closes the sixth side of the body 4. The cover plate 6 has an outwardly directed face 8 and is attached to the housing body 4 by means of screws 10. In accordance with the invention, the housing 4, 6 has a mounting end substantially perpendicular to the face 8. When the device 2 has the overall rectangular configuration shown in FIGS. 1–8, the mounting end 12 may be any one of the three sides perpendicular to the face 8 that does not have a switch operating member extending therethrough or mounted thereon.

The device 2 also includes an activator switch 16 mounted in the housing 4, 6. The switch 16 is mounted on an inside sidewall surface of the housing body 4 by fasteners 17. It has an operating lever 18 that extends outwardly through an aperture 14 extending through the cover plate 6 and its outer face 8. As shown in the drawings, the lever 18 is pivotably connected to the switch body at one end and is biased into a projecting position in which the outer end projects outwardly through the aperture 14. The outer end of the lever 18 carries a roller 20. The lever 18 and, more specifically, the outer end with the roller 20 is movable out of its projecting position shown in FIG. 1 toward the face 8 of the housing 4, 6 and into a depressed position, shown in FIG. 8.

The lever-operated switch 16 shown in the drawings is currently the preferred embodiment of the activator switch. However, other types of switches having projecting portions that are movable into a depressed position may also be used without departing from the spirit and scope of the invention. For example, a suitable switch configuration would be one in which the switch is operated by a button that projects perpendicularly from the outer face 8 and is moved into its depressed position by a pushing force that causes it to translate inwardly in a direction perpendicular to the face 8.

An important feature of the invention is that the projecting portion of the activator switch 16 is always within the periphery of the device 2, i.e. it is within the periphery when it is in either of its projecting position or its depressed position and remains within the periphery when it is being moved from one of such positions to the other. In the case of the device 2 shown in FIGS. 1–8, the outer periphery is the four outer edge of the front of the device 2 or, more specifically, the four outer edges defining the rectangular face 8 of the cover plate 6. The aperture 14 extends through the cover plate 6 with in this periphery.

Still referring to FIGS. 1—8, the device 2 also includes an audible alarm 22 and a disable switch 28 carried by the housing 4, 6. The alarm 22 is mounted by fasteners 23 inside the housing body 4 behind the cover plate 6. The cover plate 6 is provided with a plurality of holes 24 so that the sound of the alarm 22 can easily pass through the plate 6. The alarm 22 is powered by a battery 26 in the illustrated embodiment 2. Alternatively, the device could be wired to receive power from a conventional electrical outlet. Referring to the circuit diagram in FIG. 6, the alarm 22 is connected by the device circuit to the activator switch 16, the battery 26 and the disable switch 28. When the device 2 is in use, the disable switch 28 is normally closed so that the activator switch 16 is operatively connected to the alarm 22. The operative connection of the activator switch 16 to the alarm 22 is such that the alarm 22 is activated and sounds a loud warning signal when the lever 18 of the activator switch 16 is in its projecting position shown in FIGS. 1–3. The alarm 22 is deactivated and no longer broadcasts its warning signal when the lever 18 is in its depressed position.

Referring to FIGS. 1, 4, 5, and 7, the disable switch 28 is mounted by fasteners 29 (FIG. 1) on the inside surface of one of the sides of the housing body 4. The housing sidewall has a slot 30 formed therein through which a slide member 32 of the disable switch 28 extends. This positions the slide member 32 for manual operation of the disable switch 28. When it is desired to deactivate the device 2, all that is necessary is to slide the member 32 along the slot 30 to open the circuit and thereby defeat the operative connection between the activator switch 16 and the alarm 22.

The device of the invention is primarily designed for use with cabinets of the type illustrated in FIGS. 7 and 8. A typical example would be a kitchen cabinet that is accessible to a small child. Referring to FIGS. 7 and 8, the cabinet 60 has an opening 62 which may be closed by a cabinet door 64. The door 64 opens outwardly to provide access through the opening 62 to the interior space defined by the cabinet walls. In FIG. 7, a portion of a second cabinet door 64 is shown in a closed position in which it is substantially flush up against the edges of the cabinet walls. The device 2 is designed to be attachable to the cabinet 60 in a position in which it is inside the interior space of the cabinet 60 with the outer face 8 of the cover plate 6 directed outwardly from the interior space adjacent to the opening 62.

A major advantage of the device of the invention is its ease and reliability of use. All that is required is to attach the device 2 to the cabinet 60 in the position shown in FIGS. 7 and 8 and make sure that the disable switch 28 is off. The device 2 is positioned so that the projecting lever 18 of the activator switch 16 is contacted by the cabinet door 64 when the door 64 is moved into its closed position. The closing of the door 64 moves the lever 18 into its depressed position shown in FIG. 8. When the cabinet door 64 is subsequently opened, the lever 18 moves outwardly into its projecting position. The outward movement of the lever 18 activates the audible alarm 22 to alert an adult in the vicinity when the cabinet door 64 has been opened by a child.

The attaching of the device 2 to the cabinet 60 may be accomplished in various ways. The currently preferred method of attaching is to provide the device 2 with one or more adhesive strips 34. These strips 34 may be placed on any of the three side surfaces of the housing body 4 that are perpendicular to the outer face 8 and that do not have the disable slide member 32 extending therethrough. As shown in FIGS. 2–5, the device 2 may be provided with adhesive strips 34 on more than one of the three sides to permit the user to choose between alternate orientations of the device 2.

The illustrated preferred embodiment of the adhesive strips 34 comprise thin flat foam bodies with pressure sensitive adhesive on the opposite faces thereof. One face is adhesively secured to the mounting end 12 of the housing body 4. The other face has a protective cover over the adhesive which is removed when it is desired to attach the device 2 to a structure 60. When the protective covering is removed, all that is required is to exert a force on the housing body that presses the adhesive strips 34 against the inner cabinet wall surface to which the device 2 is to be attached.

Figure 9:
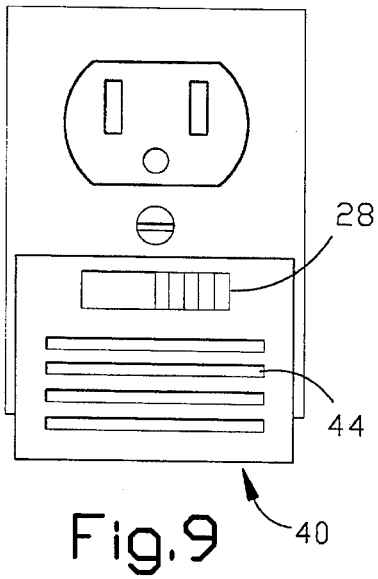
FIG. 9 is a front elevational view of a second housing part of another embodiment of the invention.
Figure 10:
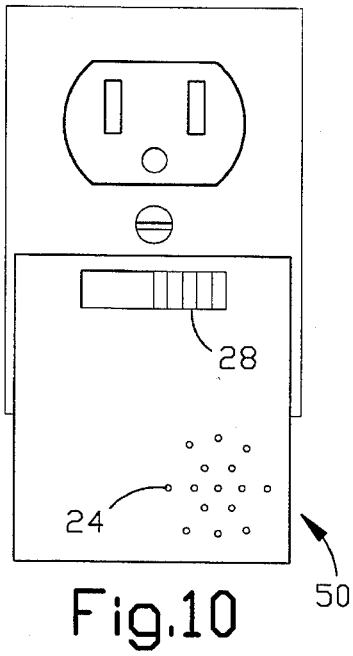
FIG. 10 is a front elevational view of a second housing part of still another embodiment of the invention.
Figure 11:
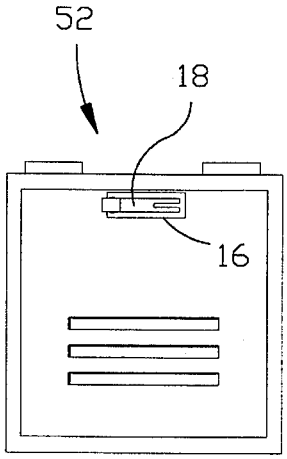
FIG. 11 is like FIG. 5 except that it shows the first housing part that accompanies the second housing part shown in FIG. 10.

FIGS. 9–11 illustrate two alternative embodiments of the invention. In each of these embodiments, the housing of the device is a two-part housing rather than a one-piece housing, as shown in FIGS. 1–8. The first housing part is mounted inside the cabinet in the manner shown in FIGS. 7 and 8. The second housing part is separate from the first to permit it to be positioned outside the interior space of the cabinet.

Referring to FIG. 9, the second housing part 40 is provided with a plug that is receivable into an ordinary wall socket. Alternatively, it could be battery operated. The housing 40 has mounted thereon a disable switch 28 of the same type as the slide switch 28 shown in FIGS. 1, 2, and 4–6. A transmitter 44 is mounted inside the housing part 40 for transmitting a signal from the second housing part 40 to the first housing part. The first housing part (not shown) is substantially the same as the housing 4, 6 shown in FIGS. 1–8. The major difference is that the slide switch 28 is omitted and is replaced by an element in the circuit that opens and closes the circuit in response to a signal from the second housing part 40. Preferably, the circuit is closed when no signal is being received from the second housing part 40, and the disable component in the first housing part is only activated when it receives a signal from the transmitter 44 of the second housing part 40. This arrangement ensures that the alarm 22 will not inadvertently be disengaged if for some reason the power source for the second housing part 40 is disrupted. The main advantage of the embodiment of FIG. 9 is that the alarm 22 may be disabled by an adult before the adult opens the cabinet door so that undesired sounding of the alarm 22 can be avoided.

FIGS. 10 and 11 show a second alternative embodiment of the invention. This embodiment has first and second housing parts 52, 50 shown in FIGS. 11, 10, respectively. Referring to FIG. 10, the second housing part 50 has mounted thereon a disable switch 28 and an alarm 22 of the same types as the disable switch 28 and alarm 22 shown in FIGS. 1–8. Like the second housing part 40 shown in FIG. 9, the second housing part 50 may be plugged into a wall socket (as shown) for power or, alternatively, may be provided with a battery. Referring to FIG. 11, the first housing part 52 has mounted thereon an activator switch 16 of the same construction as in the embodiment shown in FIGS. 1–8, a battery, and a transmitter. The transmitter is activated by movement of the lever 18 of the activator switch 16 into its projecting position and sends a signal to the second housing part 50 that activates the alarm 22. This embodiment has the advantages of allowing the housing part 52 that is mounted inside the cabinet to be smaller than in the other embodiments. It is also allows the alarm to be powered directly from the central power source for the home or other building in which the cabinet is located and possibly be better oriented to be heard by a supervising adult.

Each of the components of the embodiments of the invention described above are standard off-the-shelf items. The activator switch is preferably the type of lever switch 16 shown in the drawings, and the disable switch is preferably the type of slide switch 28 shown in the drawings. However, other types of switches may also be used. The voltage of the battery may be varied. In the illustrated embodiments, the battery 14 is a standard nine-volt battery.

Although the preferred embodiments of the invention have been illustrated and described herein, it is intended to be understood by those skilled in the art that various modifications and omissions in form and detail may be made without departing from the spirit and scope of the invention as defined by the following claims.

What is claimed is:

1. For use with an outwardly opening closure for an opening in a structure, said structure defining an interior space accessible through said opening, and said closure having a closed position in which it closes said opening and being movable outwardly away from said interior space and said opening from said closed position to an open position to provide access to said interior space, a warning device to signal that said closure has been moved out of said closed position toward said open position, comprising:

a housing having an outer face and a mounting end substantially perpendicular to said face, said mounting end being attachable to said structure to position the device inside said interior space with said face directed outwardly adjacent to said opening, and said face being bounded by a periphery and having an aperture and at least one hole extending therethrough within said periphery;

an audible alarm mounted in said housing, said alarm being directed toward said hole to allow sound from said alarm to pass through said face and be directed outwardly through said opening;

an activator switch mounted in said housing and having a projecting portion biased into a projecting position in which it projects outwardly through said aperture; said projecting portion being movable out of said projecting position toward said face and into a depressed position, and said projecting portion being and remaining within said periphery when it is in either of said projecting and depressed positions and as it moves between said projecting and depressed positions; and said activator switch normally being operatively connected to said alarm so that said alarm is activated when said projecting portion is in said projecting position and is deactivated when said projecting portion is in said depressed position; and a disable switch mounted on said housing in a position accessible for manual operation and being manually movable into a position in which it prevents activation of said alarm by movement of said projecting portion into said projecting position;

wherein said projecting portion is configured to be contacted and moved into said depressed position by said closure when said mounting end is attached to said structure, said face is directed outwardly adjacent to said opening, and said closure is moved into said closed position.

2. The device of claim 1, comprising a fastener positioned to attach said mounting end to said structure; said fastener comprising a strip of material with opposite faces, each of which has a layer of pressure sensitive adhesive thereon, and one of which is secured to said mounting end by said adhesive.

3. The device of claim 2, in which said housing is a one-piece housing, and said disable switch is mounted spaced from said mounting end on a surface of said housing substantially perpendicular to said face.

4. The device of claim 1, in which said housing is a one-piece housing, and said disable switch is mounted spaced from said mounting end on a surface of said housing substantially perpendicular to said face.

5. For use with an outwardly opening closure for an opening in a structure, said structure defining an interior space accessible through said opening, and said closure having a closed position in which it closes said opening and being movable outwardly away from said interior space and said opening from said closed position to an open position to provide access to said interior space, a warning device to signal that said closure has been moved out of said closed position toward said open position, comprising:

a first housing and a second housing; said first housing having an outer face and a mounting end substantially perpendicular to said face, said mounting end being attachable to said structure to position said first housing inside said interior space with said face directed outwardly adjacent to said opening, and said face being bounded by a periphery and having an aperture extending therethrough within said periphery;

an audible alarm carried by one of said housings;

an activator switch mounted in said first housing and having a projecting portion biased into a projecting position in which it projects outwardly through said aperture; said projecting portion being movable out of said projecting position toward said face and into a depressed position, and said projecting portion being and remaining within said periphery when it is in either of said projecting and depressed positions and as it moves between said projecting and depressed positions; and said activator switch normally being operatively connected to said alarm so that said alarm is activated when said projecting portion is in said projecting position and is deactivated when said projecting portion is in said depressed position; and a disable switch mounted on said second housing in a position accessible for manual operation and being manually movable into a position in which it prevents activation of said alarm by movement of said projecting portion into said projecting position;

wherein said projecting portion is configured to be contacted and moved into said depressed position by said closure when said mounting end is attached to said structure, said face is directed outwardly adjacent to said opening, and said closure is moved into said closed position;

in which said second housing is separate from said first housing to permit said second housing to be positioned, in use, outside said interior space; said disable switch having a manual operator and a transmitting portion carried by said second housing, and a receiving portion carried by said first housing.

* * * * *